US009357857B2

(12) United States Patent
Brozak

(10) Patent No.: US 9,357,857 B2
(45) Date of Patent: Jun. 7, 2016

(54) COLLAPSIBLE RETAIL DISPLAY

(71) Applicant: American Greetings Corporation, Cleveland, OH (US)

(72) Inventor: Emory Brozak, Strongsville, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 14/534,330

(22) Filed: Nov. 6, 2014

(65) Prior Publication Data

US 2015/0129528 A1 May 14, 2015

Related U.S. Application Data

(60) Provisional application No. 61/902,403, filed on Nov. 11, 2013.

(51) Int. Cl.

| | |
|---|---|
| ***A47B 43/00*** | (2006.01) |
| ***A47B 47/00*** | (2006.01) |
| ***A47B 57/00*** | (2006.01) |
| ***A47F 7/14*** | (2006.01) |
| ***A47F 3/00*** | (2006.01) |
| ***A47F 5/00*** | (2006.01) |
| ***A47F 5/10*** | (2006.01) |
| ***A47B 47/05*** | (2006.01) |

(52) U.S. Cl.

CPC ..... *A47F 3/004* (2013.01); *A47B 47/0033* (2013.01); *A47B 47/0083* (2013.01); *A47B 47/0091* (2013.01); *A47B 47/05* (2013.01); *A47F 5/0043* (2013.01); *A47F 5/10* (2013.01); *A47F 5/108* (2013.01); *A47F 7/141* (2013.01); *A47F 7/145* (2013.01); *A47F 2005/0075* (2013.01)

(58) Field of Classification Search

CPC ..... A47B 31/00; A47B 47/0083; A47B 47/0033; A47B 47/0091; A47B 47/02; A47B 47/021; A47B 47/00; A47B 47/0066; A47B 47/0075; A47B 47/03; A47B 47/05; A47B 96/14; A47B 96/201; A47F 3/004; A47F 5/0043; A47F 3/00; A47F 3/06; A47F 3/14; A47F 5/0018; A47F 2005/0075; A47F 5/10; A47F 7/141; A47F 7/145; A47F 5/16; A47F 5/0062; A47F 5/105; A47F 5/108; A47F 5/135; A47F 5/137; A47F 2005/165; A47F 7/0042; A47F 7/163

USPC ..... 211/186, 189, 55, 52; 40/642.01, 40/642.02

See application file for complete search history.

(56) References Cited

U.S. PATENT DOCUMENTS 3,243,047 A * 3/1966 Witteborg ..... A47F 7/148 211/163
3,908,830 A * 9/1975 Skrzelowski ..... A47F 7/146 211/134
4,299,327 A * 11/1981 Thauer ..... A47F 5/01 211/126.9

(Continued)

*Primary Examiner* — Jennifer E Novosad
(74) *Attorney, Agent, or Firm* — Christine Flanagan

(57) ABSTRACT

The collapsible display of the present disclosure and related inventions includes a plurality of pre-assembled parts which can be configured, without the use of tools, to form a reusable, merchandising display fixture. The display is quickly and easily constructed and quickly and easily deconstructed and stored. The entire display, with merchandise thereon, may be placed upon or integral with a standard shipping pallet for maximum mobility around the retail floor space. The collapsible display provides an inexpensive, collapsible, reusable display requiring minimum storage space when not in use.

9 Claims, 7 Drawing Sheets

(56) References Cited

U.S. PATENT DOCUMENTS 4,444,322 A 4/1984 Lee
4,460,097 A * 7/1984 Darnell, II ..... A47F 7/145 108/108
5,029,715 A * 7/1991 Strada ..... A47F 7/163 211/128.1
5,201,191 A * 4/1993 Bustos ..... A47F 5/101 211/187
5,794,782 A * 8/1998 Ascik ..... A47F 11/04 206/600
D398,460 S * 9/1998 Gerstner ..... D6/675.4
6,405,880 B1 * 6/2002 Webb ..... A47F 1/12 108/107
6,607,083 B1 * 8/2003 Webb ..... A47F 1/12 108/107
6,659,294 B1 * 12/2003 Simard ..... A47F 5/01 108/147.11
6,729,484 B2 * 5/2004 Sparkowski ..... A47F 5/137 211/134
6,915,914 B2 * 7/2005 Farrand ..... A47F 3/002 211/163
D584,078 S * 1/2009 Weigand ..... D6/672
7,748,803 B2 * 7/2010 Bazany ..... A47F 5/0093 108/143
7,900,784 B1 * 3/2011 Weigand ..... A47F 5/005 211/186
D655,105 S * 3/2012 Mason ..... D6/680
8,132,679 B2 * 3/2012 Berry ..... A47F 7/0014 211/55
8,505,753 B2 * 8/2013 Clark ..... A47F 5/10 211/186
8,919,579 B2 * 12/2014 Weigand ..... A47F 7/144 211/186
2001/0025823 A1 * 10/2001 Brozak ..... A47F 1/12 211/55
2002/0088765 A1 * 7/2002 Waldron ..... A47F 7/145 211/128.1
2003/0121872 A1 7/2003 Gervasi
2004/0020878 A1 * 2/2004 Boron ..... A47F 5/0018 211/59.2
2004/0140276 A1 * 7/2004 Waldron ..... A47F 7/145 211/51
2004/0256341 A1 * 12/2004 Donnell ..... A47F 1/12 211/187
2005/0139561 A1 * 6/2005 Ohkubo ..... A47F 5/0062 211/128.1
2005/0230338 A1 * 10/2005 Farinola ..... A47F 5/0838 211/186
2006/0011565 A1 * 1/2006 Pirro ..... A47F 5/0018 211/59.2
2006/0016774 A1 * 1/2006 Bustos ..... A47B 45/00 211/186
2009/0050589 A1 2/2009 Pedler et al.
2015/0129528 A1 * 5/2015 Brozak ..... A47F 3/004 211/186

* cited by examiner

COLLAPSIBLE RETAIL DISPLAY

RELATED APPLICATIONS

This application claims priority to U.S. Provisional Patent Application No. 61/902,403, filed on Nov. 11, 2013, a copy of which is incorporated herein by reference in its entirety.

FIELD OF THE INVENTION

The present invention is in the field of retail display fixtures, and more specifically, retail display fixtures for greeting card and social expression product merchandise.

BACKGROUND OF THE INVENTION

Greeting cards for various occasions such as birthday, anniversary, wedding, etc. typically have a general location in which they are displayed at retail among various greeting card display fixtures. Due to the large variety of greeting cards that are offered in each category, many times entire display fixtures are dedicated to cards specific to a particular occasion or event. However, some seasonal greeting cards, such as, for example, Halloween, Easter, Mother's Day and Father's Day, or special product collections may not have a specific location or home among the categorized greeting cards on a conventional or generic greeting card fixture. This has in the past been remedied by using separate, temporary outpost fixtures to store and display cards for a limited time during a particular season or holiday. These fixtures were often constructed with temporary materials, such as cardboard, and attached to a pallet and pre-loaded with product which was moved into the greeting card department or other area of a retail store. Once the season or holiday passed, these temporary fixtures were discarded and new temporary fixtures were purchased for the next season or holiday. This practice added extra costs by requiring the purchase of new temporary storage displays for each new season or holiday. Another solution was to use collapsible displays having various hinges and sliding accessories. These collapsible displays were set up during each season or holiday and broken down after the season. This solution solved the temporary, one-use fixture dilemma of creating extra costs each time a new temporary fixture was needed, however, the collapsible displays were not compact when collapsed and thus took up a large amount of limited retail storage space during the off seasons. There is therefore a need in the industry for a reusable retail display fixture which can be easily assembled when needed and easily broken down and compactly when not in use.

SUMMARY OF THE INVENTION

The collapsible retail display of the present disclosure and related inventions includes a plurality of pre-assembled parts which can be configured, without the use of tools, to form a reusable, seasonal or occasional greeting card display fixture. The display is quickly and easily constructed and deconstructed and storable within a larger greeting card display fixture. The entire display, with merchandise, may be easily moved by the use of a fork lift, thereby providing maximum mobility around the retail floor space. The collapsible retail display provides an inexpensive, collapsible, reusable display requiring minimum storage space when not in use.

DETAILED DESCRIPTION OF PREFERRED AND ALTERNATE EMBODIMENTS

The present invention is directed to a collapsible and storable display having a plurality of pre-assembled parts or components which can be combined, without the use of tools, to make up a re-usable display for seasonal or occasional merchandise such as seasonal greeting cards and other social expression products. The display can be quickly assembled and disassembled and can be stored within a larger display drawer or cabinet. This display provides an economical, reusable, collapsible display which takes up minimum storage space when not in use and which prevents the waste and added expense of typical temporary, cardboard seasonal or occasional merchandise displays.

Figure 7:
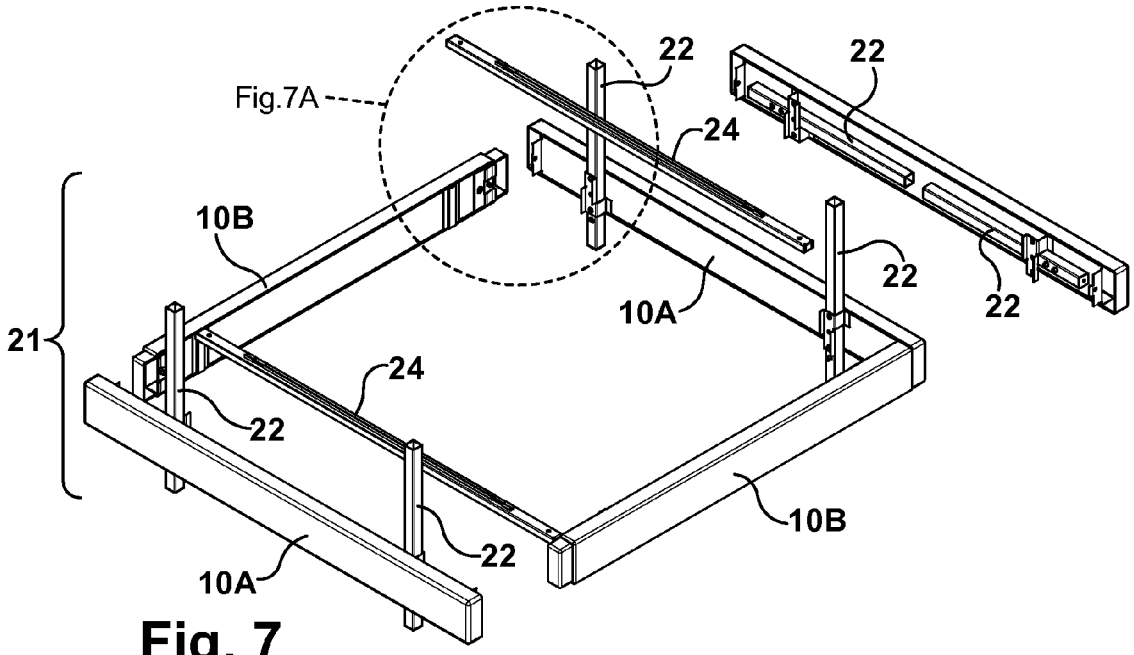
FIG. 7 is a perspective view of a partially assembled display frame of the Collapsible Retail Display of FIG. 1.
Figure 7A:
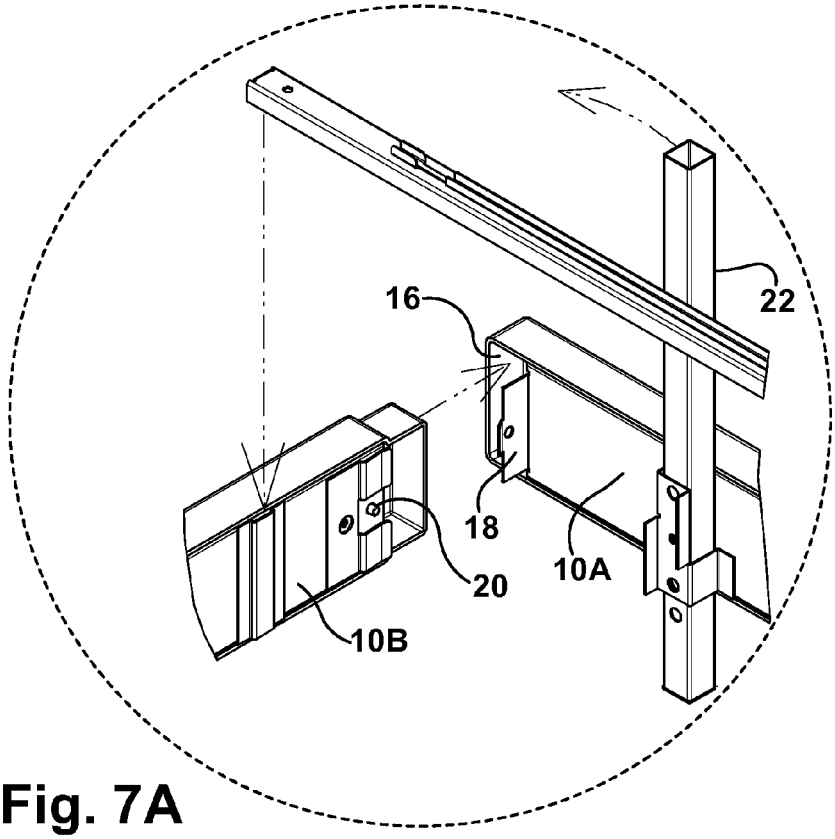
FIG. 7A is a close-up view of a portion of the display frame of the Collapsible Retail Display of FIG. 7.

The various components of the display 100 of the present invention are all pre-assembled and contained within a carton. Setup is achieved by assembling the various parts to create a bumper base and framework which supports attached clear greeting card tiers or pockets and/or pegboard for the display of hanging products. Assembly does not require any tools, making setup quick and easy. The display frame 27 includes bumper panels 10A, 10B, corner posts 12, and long 14L and short 14S cross braces. Four bumper panels 10A, 10B are connected in a substantially square shape, thereby creating the base of the display fixture, shown in FIG. 7. A first pair 10A of opposing bumper panels contain a channel 16 at each end and a bracket 18 having a small opening or aperture thereon. A second pair of opposing bumper panels 10B have a button or projection 20 thereon. The ends of the second pair of opposing bumpers 10B are inserted into the channels 16 at the ends of the first pair of opposing bumpers 10A and the button or projection 20 is snapped into the bracket 18 to form a secured, substantially square display base, as shown in FIG. 7A. The first pair of opposing bumper panels 10A each contain two tube legs 22 attached thereto at a pivotable attachment point. Each pair of legs 22 are operative to move from a first position wherein the legs 22 are in a stored position parallel to the attached display frame bumper panel 10A into a second position wherein the legs 22 are pivoted about the attachment point into a locked position, perpendicular to the display frame bumper panel 10A to which they are attached, as shown in FIG. 7. The pivotable legs 22 can be placed into the storage position when the display 100 is taken down and put into storage. When setting up the display 100, the legs 22 are moved into the second, locked position, where they are operative to support the corner posts 12 of the display 100. The display base also contains two support rails 24 which are attached between the second pair of opposing bumper panels 10B. The ends of the support rails 24 are secured to the base by fitting the tabs contained thereon into channels formed on the second pair of opposing bumper panels 10B, also shown in FIG. 7A. After securing each of the bumper panels 10A, 10B together, moving the tube legs 22 into the upright, locked position and securely attaching the support rails 24, the base frame of the display is complete. The completed base frame 21 is sized to accommodate a fork lift so the entire fixture may be picked up and moved to various locations within the retail floor space.

Figure 5:
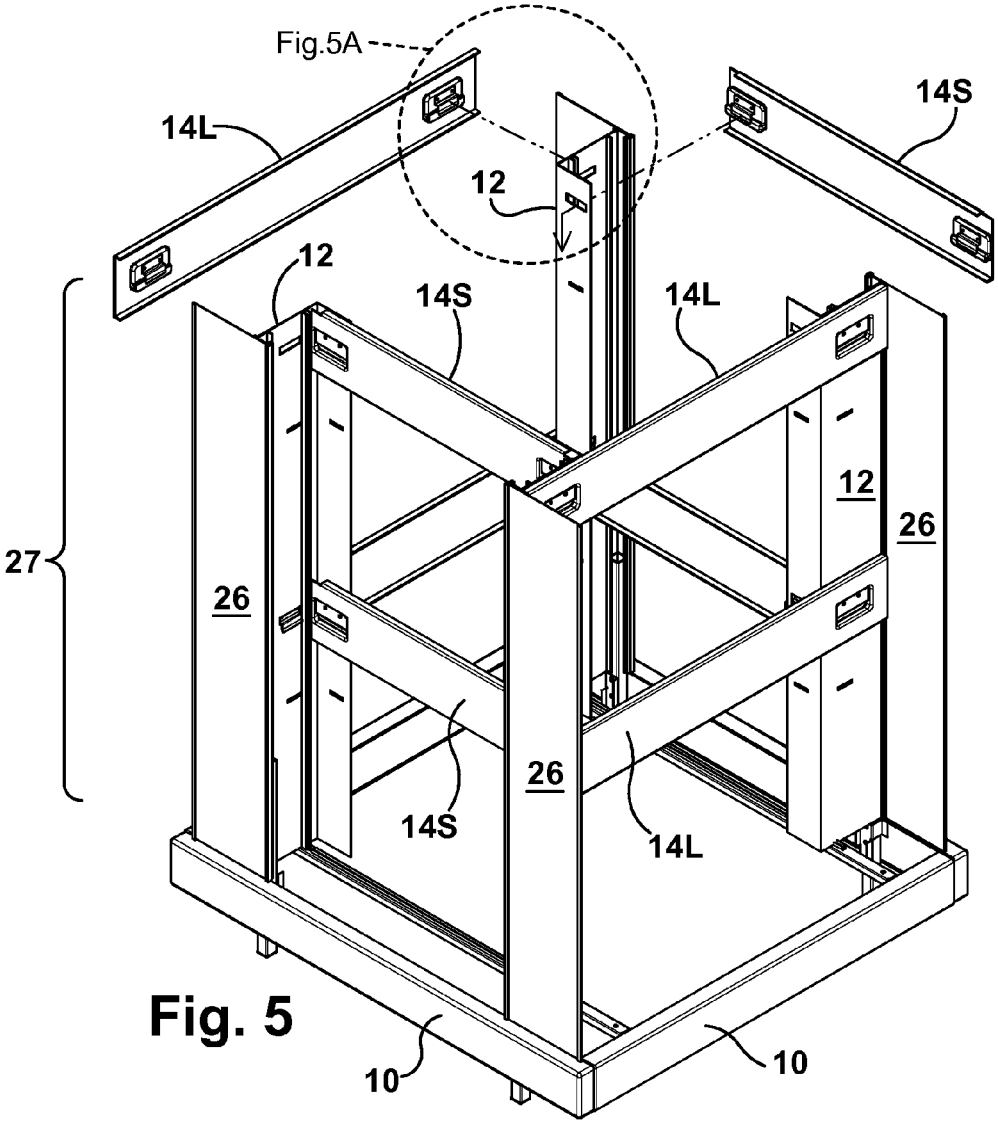
FIG. 5 is a perspective view of a partially assembled Collapsible Retail Display of FIG. 1.
Figure 5A:
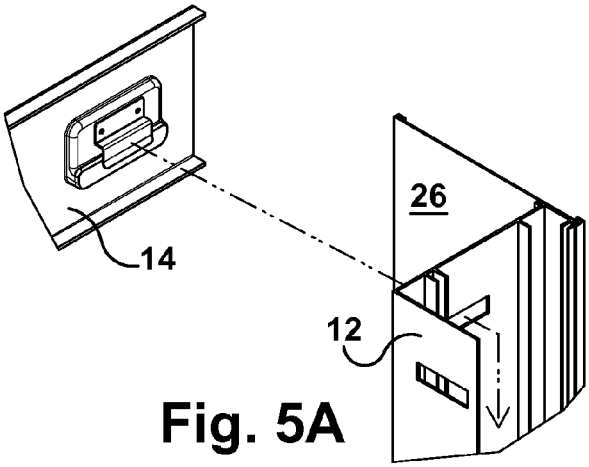
FIG. 5A is a close-up view of a portion of the Collapsible Retail Display of FIG. 5.
Figure 6:
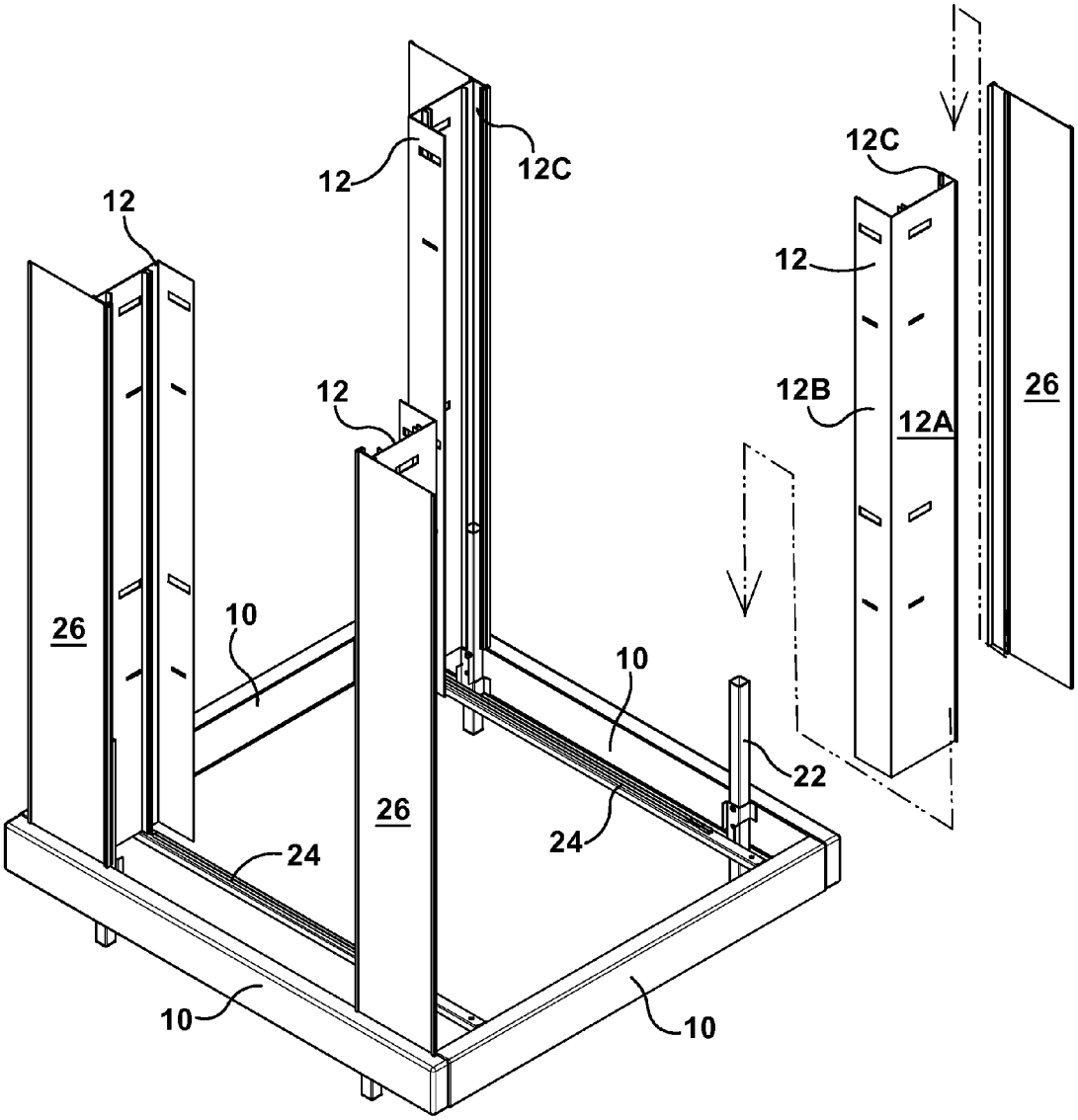
FIG. 6 is a perspective view of a partially assembled Collapsible Retail Display of FIG. 1.

A corner post 12 is inserted over each of the four tube legs 22 which are in the upright and locked position. Each of the four corner posts 12 contain an elongate channel which is inserted over the tube legs, as shown in FIG. 6. The elongate channel 12C is connected and perpendicular to a first end of a first panel 12A, the second end of the first panel 12A being attached to a second panel 12B which is also perpendicular to the first panel 12A. A sign holder panel 26 is slidably attached to an outer surface of each corner post 12. The sign holder panels 26 are positioned perpendicular to the first panel 12A of each of the four corner posts 12. Attaching the sign holder panels 26 creates two opposing long sides of the display and two opposing shorter sides of the display. Horizontal cross braces 14 are connected between each opposing corner post 12. Two long cross braces 14L are connected between each sign holder panel 26 on the longer sides of the display and two short cross braces 14S are connected between each opposing corner posts 12 on the shorter sides of the display, as shown in FIG. 5. The cross braces 14 and the corner posts 12 each contain a variety of channels and/or protrusions, such as those shown in FIG. 5A, which allow the components of the display to slide or snap together for assembly without the use of tools.

Figure 3A:
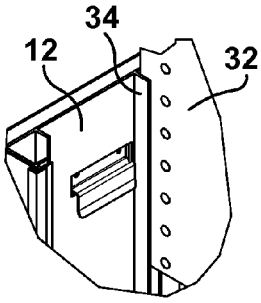
FIG. 3A is a close-up view of a portion of the Collapsible Retail Display of FIG. 4.
Figure 3:
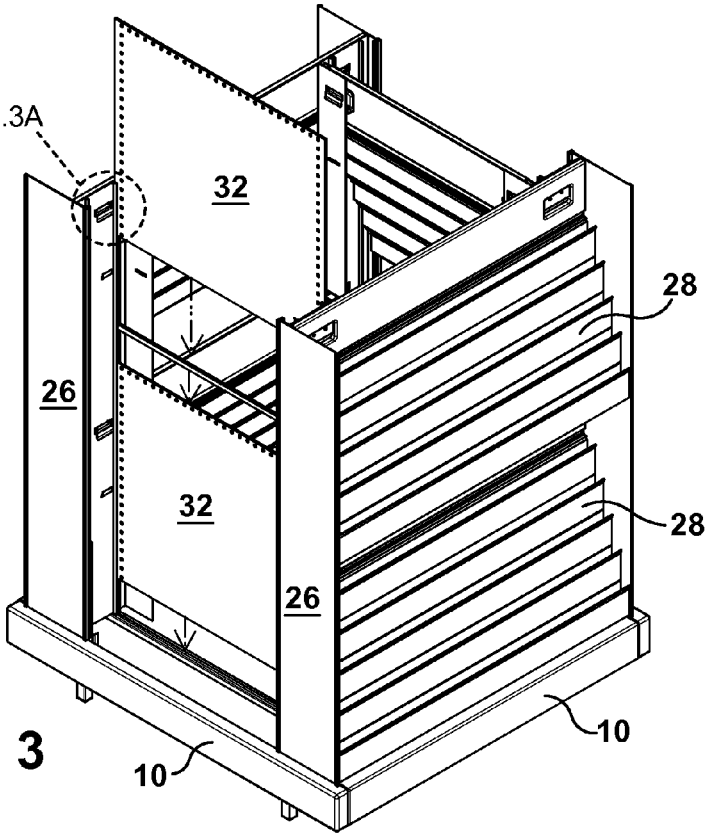
FIG. 3 is a partially exploded view of a partially assembled Collapsible Retail Display of FIG. 1.
Figure 4:
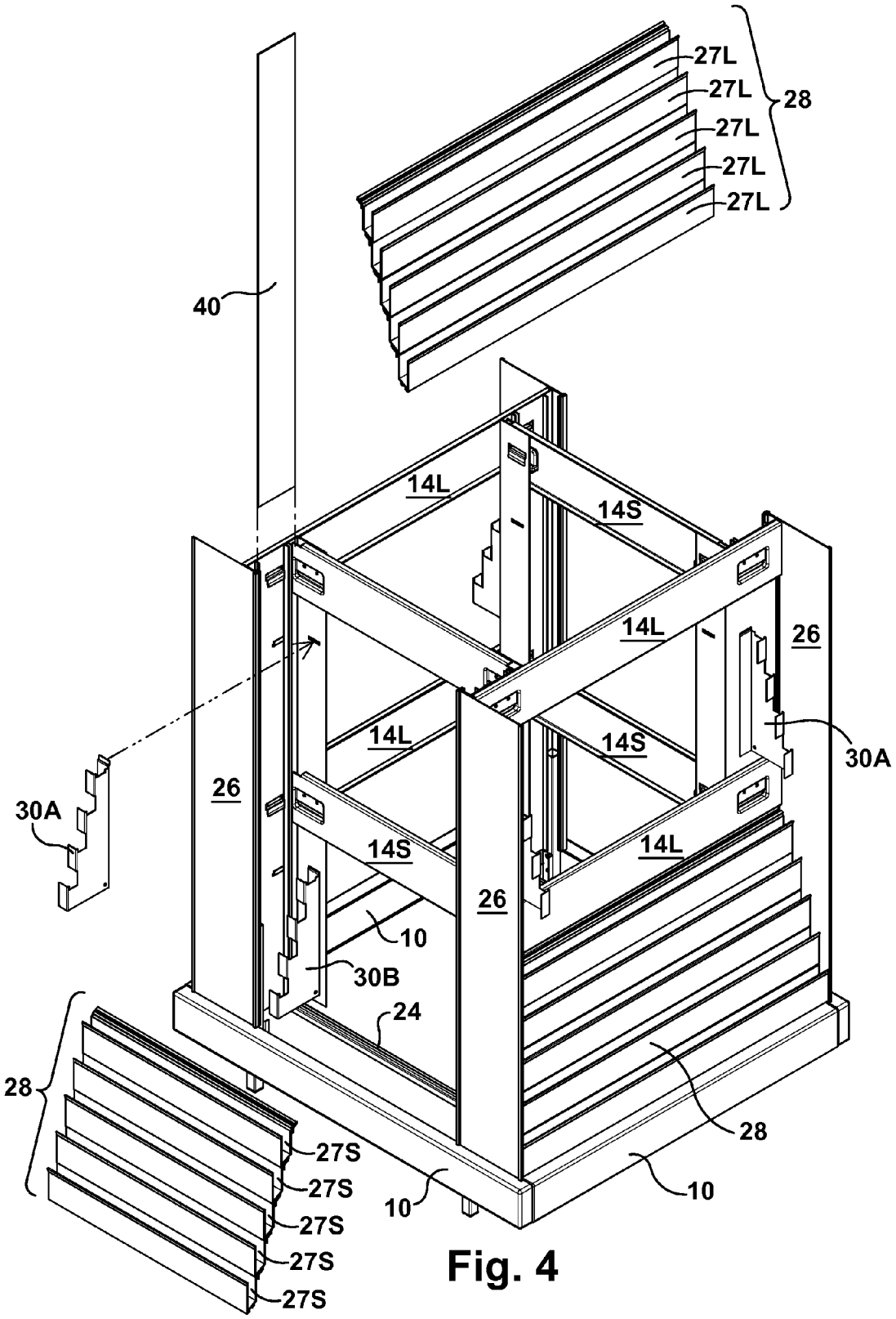
FIG. 4 is an exploded view of a partially assembled Collapsible Retail Display of FIG. 1.

Once the display frame 27 is built, tiered card pockets 28 can be added to one or more sides of the display 100. Two sets of tiered support brackets 30 are attached between each opposing corner post 12. A first pair of tiered support brackets 30A are attached to an upper portion of each corner post 12 proximate to and/or supported by the lower cross brace 14. A second pair of tiered support brackets 30B are attached to a lower portion of each corner post 12 proximate to and/or supported by the support rails 24, as shown in FIG. 4. Each card pocket on the tiered card pocket panels 28 is an extruded, clear acrylic blend of plastic having a substantially u-shaped channel into which greeting cards may be inserted and displayed. In a preferred embodiment, each card pocket panel 28 is a single integral piece having five individual pockets or rows 27. However, each card pocket or row 27 can be an individual item which are slidably (or otherwise) attached to other card pocket or row 27. Also, the single, integral card pocket panel 28 may contain any number of rows and can be made in different lengths. The tiered card pocket panels 28 can be attached to one another using one or more support brackets. The card pockets 28 can come in a short size 27S and can be placed on each short side of the display 100. The card pockets 28 can also come in a longer size 27L to be placed on each long side of the display 100. In the preferred embodiment, one card pocket panel 28 having five attached card pockets can be placed on an upper support bracket 14 and one card pocket panel having five integral card pockets can be attached to a lower support bracket 14, as shown in FIG. 4. Therefore, each side of the display can accommodate up to ten greeting card pockets. Card pocket panels 28 containing any number of tiered card pockets may be used or a combination of card pocket panels having the same or a different number of card pocket tiers may be used. Alternatively, a pegboard panel 32 may be attached to one or more sides of the display in place of the greeting card pockets 28. A pegboard panel 32 is a board which is pre-drilled with evenly spaced holes which can be fitted with various attachment mechanisms used to display merchandise thereon. The pegboard panel 32 may be slid into a channel 34 along the sides of each opposing corner post 12. The pegboard panel 32 may be a single panel or may be made up of two or more separate panels, as shown in FIG. 3, for easier storage. The pegboard panels 28 may also come in a small size to accommodate the shorter sides of the display 100 or a larger size to accommodate the longer sides of the display 100. Each side of the display can accommodate either ten rows of card pockets or a pegboard panel. Optionally, a side cover panel 40 can be slid onto the inside surface of each corner post 12 to cover the structure and provide a uniform surface.

Figure 1:
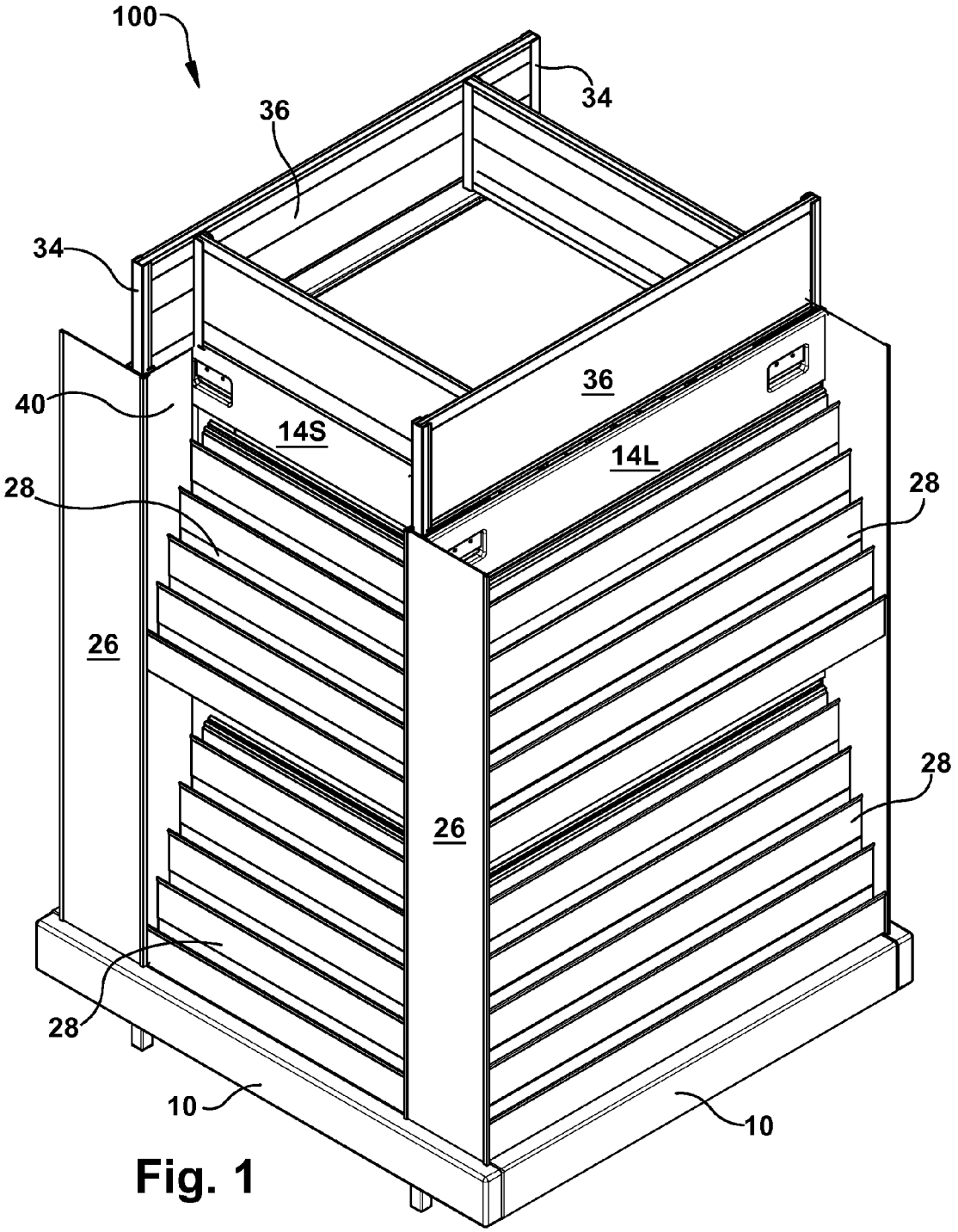
FIG. 1 is a perspective view of a fully assembled Collapsible Retail Display of the present invention.
Figure 2:
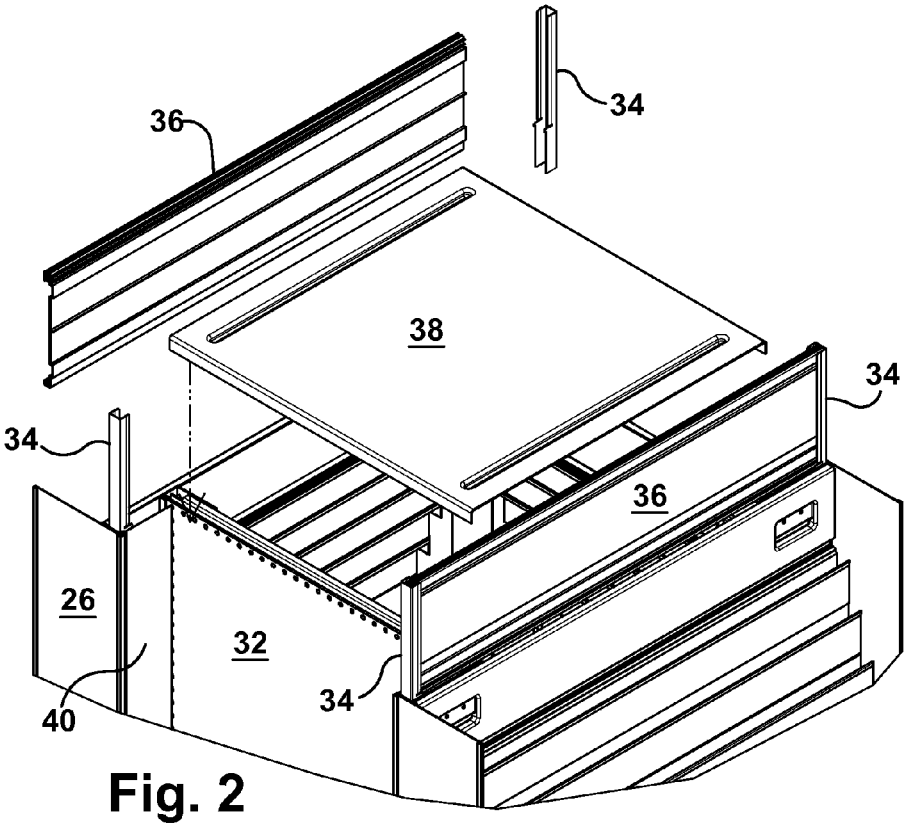
FIG. 2 is an exploded view of a top portion of the Collapsible Retail Display of FIG. 1.

Optional sign holder brackets 34 may be inserted into the top end of each corner post 12 for holding signage 36 therebetween, as shown in FIG. 2. The sign holder brackets 34 contain u-shaped channels so that signs can easily be inserted into and removed therefrom. Each side of the display can accommodate one sign 36 which spans the length of the side. The sign holder brackets 34 and signs 36 are optional and can be placed on one or more sides of the display or can be removed completely therefrom. Also, an optional top cover 38 can inserted over the top center portion of the display 100, as shown in FIG. 2. A fully assembled display 100 is shown in FIG. 1.

In a preferred embodiment, each long side of the display is approximately 42-inches wide with approximately 37 ⅛-inches of card pocket or pegboard space and each short side of the display is approximately 40-inches wide with approximately 24 ¼-inches of card pocket or pegboard space. The length of the display is approximately 47 ½-inches without signage and approximately 63 ¼ with signage. Also, in the preferred embodiment, the base or bumper frame is made of sheet metal, steel tubing and vacuum formed ABS plastic, which can resist impact from shopping carts, etc. Corner channels and sign holder are made of extruded high impact polystyrene plastic. The horizontal cross-braces are made of vacuum formed high impact polystyrene. Card pockets are extruded clear acrylic blend plastic and support brackets are sheet metal.

Figure 8:
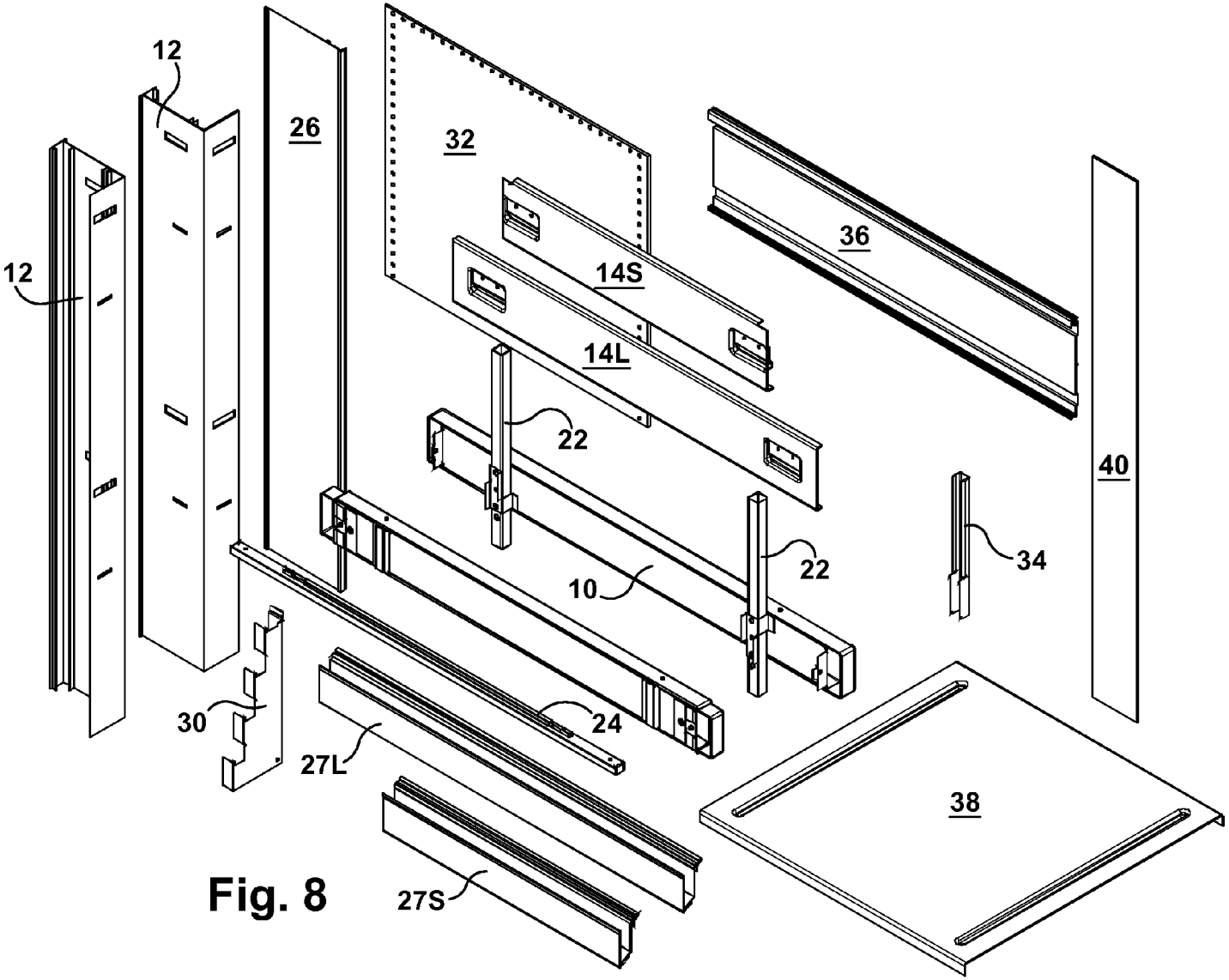
FIG. 8 is an exploded view of the various components of the Collapsible Retail Display of FIG. 1.

Just as the display fixture of the present invention can be quickly and easily constructed, it can just as quickly and easily be disassembled or taken down. Since the components can be snapped or slid into place, there are no small attachment devices which must be taken apart with the use of tooling. Once the components of the display are broken down and taken apart, the individual parts can easily be stored within one or two larger, existing greeting card fixtures during extensive time periods between major selling seasons. Many of the components of the display are made up of individual pieces that are slidably attached to other components via various channels, or snapped together via male and female connection mechanisms. Most of these components, when broken down to the individual piece level are relatively flat or planar, such as the base bumper panels, support rails, cross braces, sign holders, pegboard pieces and tiered card pockets, as shown in FIG. 8. Many of the larger, standard greeting card display fixtures contain storage space which can be accessed through doors located beneath the rows of card tiers or through openings at the opposing ends of the display. The individual pieces of the display can conveniently be stored within this space.

While the collapsible display 100 of the present invention has been described herein with regard to a preferred embodiment and specific materials, sizes and locations and arrangement of parts with respect to one another, nothing in the present invention is considered to limit the scope of the invention. Different materials and sizes have been contemplated and are considered to be within the scope of the present invention. For example, card pockets and pegboard panels have been discussed herein, however, other display panels, such as slat wall panels, shelves, curved card pockets or other relevant materials or display devices may be used. Sizes of the display have been given with respect to the preferred embodiment, however, the display may be smaller, larger and in dimensions varied from the described preferred embodiment. The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated.

The invention claimed is:

1. A merchandise display comprising:

a four-sided base comprising four bumper panels arranged in a substantially square shape;

four tube legs, a first two of the four tube legs attached to a first bumper panel of the four bumper panels and a second two of the four tube legs attached to a second bumper panel of the four bumper panels, each of the four tube legs operative to move between a first position wherein each tube leg is in a stored position parallel to the first and second bumper panels and a second position wherein each tube leg is in a locked position perpendicular to the first and second bumper panels;

two support rails, each support rail attached between a third and fourth bumper panel of the four bumper panels;

four corner posts, each of the four corner post attached to a different one of the four tube legs;

one cross brace attached between each adjacent corner post;

a card pocket panel comprising a plurality of horizontal card rows attached between at least two adjacent corner posts by at least two tiered support brackets engaged with the at least two adjacent corner posts;

wherein respective attachments between the bumper panels, the tube legs, the support rails, the corner posts, the cross braces, and the card packet panels is a snap-fit, friction-fit or slide-fit attachment.

2. The merchandise display of claim 1 further comprising at least one sign holder panels attached between an adjacent pair of the four corner posts.

3. The merchandise display of claim 2 further comprising at least one sign which is inserted into the at least one sign holder panel.

4. The merchandise display of claim 2, wherein two of the four sides of the display are shorter than the other two sides.

5. The merchandise display of claim 1, wherein the four corner posts are attached to the four tube legs by sliding each of the four corner posts over a different one of the four tube legs.

6. The merchandise display of claim 1, wherein two sides of the merchandise display contain two card pocket panels and two sides of the merchandise display contain at least two peg board panels.

7. The merchandise display of claim 1, wherein the merchandise display can be assembled without the use of hand-held or power tools.

8. A merchandise display comprising:

a base comprising a first bumper panel, a second bumper panel parallel to and spaced apart from the first bumper panel, a third bumper panel attached between a first end of the first and second bumper panels, and a fourth bumper panel parallel to and spaced apart from the third bumper panel attached between a second end of the first and second bumper panel;

four legs, a first two of the four legs attached to the first bumper panel at opposing ends thereof and a second two of the four legs attached to the second bumper panel at opposing ends thereof;

at least two support rails, each support rail attached between the third and fourth bumper panels by insertion of one or more tabs on each support rail into one or more channels on the third and fourth bumper panels;

four corner posts, each corner post attached to a different one of the four legs by inserting each of the legs into a channel contained on each of the four corner posts;

one cross brace attached between each adjacent corner post by a slide or snap fit between one or more tabs contained on each cross brace and one or more channels contained on each corner post;

a card pocket panel comprising a plurality of integral horizontal card rows attached between at least two sets of adjacent corner posts by two mounting brackets slidably engaged with the at least two sets of adjacent corner posts;

at least one pegboard panel attached between at least two sets of adjacent corner posts by slidable engagement with a channel contained on each of the at least two sets of adjacent corner posts.

9. The merchandise display of claim 8, wherein the merchandise display can be assembled and disassembled without the use of hand or power tools.

* * * * *